US009451862B2

(12) United States Patent
Welch

(10) Patent No.: US 9,451,862 B2
(45) Date of Patent: Sep. 27, 2016

(54) DISHWASHER WITH UNITARY WASH MODULE

(75) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1085 days.

(21) Appl. No.: 13/486,038

(22) Filed: Jun. 1, 2012

(65) Prior Publication Data

US 2013/0319481 A1 Dec. 5, 2013

(51) Int. Cl.

| | |
|---|---|
| ***A47L 15/42*** | (2006.01) |
| ***A47L 15/00*** | (2006.01) |
| ***A47L 15/02*** | (2006.01) |
| ***A47L 15/48*** | (2006.01) |

(52) U.S. Cl.

CPC ..... *A47L 15/0021* (2013.01); *A47L 15/0078* (2013.01); *A47L 15/02* (2013.01); *A47L 15/4221* (2013.01); *A47L 15/4225* (2013.01); *A47L 15/4293* (2013.01); *A47L 15/486* (2013.01); *A47L 15/488* (2013.01); *A47L 2501/03* (2013.01); *A47L 2501/10* (2013.01); *A47L 2501/12* (2013.01)

(58) Field of Classification Search

CPC ..... A47L 15/4206; A47L 15/4225; A47L 15/23; A47L 15/4208; A47L 15/4221

USPC ..... 134/56 D, 25.2, 111, 58 D, 176, 57 D, 134/200, 179, 18, 186, 198; 239/251, 261, 239/264, 66, 227, 240, 255, 243, 245, 244, 239/237; 137/625.11, 387, 625.47, 627

See application file for complete search history.

(56) References Cited

U.S. PATENT DOCUMENTS

| | | | | |
|---|---|---|---|---|
| 1,617,021 | A | 2/1927 | Mitchell | |
| 2,154,559 | A | 4/1939 | Bilde | |
| 2,422,022 | A | 6/1947 | Koertge | |
| 2,734,122 | A | 2/1956 | Flannery | |
| 3,016,147 | A | 1/1962 | Cobb et al. | |
| 3,026,628 | A | 3/1962 | Berger, Sr. et al. | |
| 3,068,877 | A | 12/1962 | Jacobs | |
| 3,103,227 | A | 9/1963 | Long | |
| 3,122,148 | A | 2/1964 | Alabaster | |
| 3,186,417 | A | 6/1965 | Fay | |
| 3,288,154 | A | 11/1966 | Jacobs | |
| 3,378,933 | A * | 4/1968 | Jenkins | A47L 15/486 134/107 |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

German Search Report for DE102010061347, Jan. 23, 2013.

(Continued)

*Primary Examiner* — David Cormier
*Assistant Examiner* — Thomas Bucci

(57) ABSTRACT

A dishwasher for treating dishes according to at least one automatic cycle of operation and having a tub at least partially defining a treating chamber and defining an access opening, a sprayer providing a spray of liquid into the treating chamber, a liquid recirculation system defining a recirculation flow path for recirculating the sprayed liquid from the treating chamber to the sprayer and a drive system operable to control at least a position of the liquid diverter.

27 Claims, 8 Drawing Sheets

(56) References Cited

U.S. PATENT DOCUMENTS

| | | | |
|---|---|---|---|
| 3,542,594 | A | 11/1970 | Smith et al. |
| 3,575,185 | A | 4/1971 | Barbulesco |
| 3,586,011 | A | 6/1971 | Mazza |
| 3,739,145 | A | 6/1973 | Woehler |
| 3,801,280 | A | 4/1974 | Shah et al. |
| 3,846,321 | A | 11/1974 | Strange |
| 3,906,967 | A | 9/1975 | Bergeson |
| 3,989,054 | A | 11/1976 | Mercer |
| 4,179,307 | A | 12/1979 | Cau et al. |
| 4,180,095 | A | 12/1979 | Woolley et al. |
| 4,228,962 | A | 10/1980 | Dingler et al. |
| 4,326,552 | A | 4/1982 | Bleckmann |
| 4,754,770 | A | 7/1988 | Fornasari |
| 5,002,890 | A | 3/1991 | Morrison |
| 5,030,357 | A | 7/1991 | Lowe |
| 5,133,863 | A | 7/1992 | Zander |
| 5,331,986 | A | 7/1994 | Lim et al. |
| 5,454,298 | A | 10/1995 | Lu |
| 5,470,142 | A | 11/1995 | Sargeant et al. |
| 5,470,472 | A | 11/1995 | Baird et al. |
| 5,557,704 | A | 9/1996 | Dennis et al. |
| 5,569,383 | A | 10/1996 | Vander Ark, Jr. et al. |
| 5,618,424 | A | 4/1997 | Nagaoka |
| 5,630,437 | A | 5/1997 | Dries et al. |
| 5,711,325 | A | 1/1998 | Kloss et al. |
| 5,755,244 | A | 5/1998 | Sargeant et al. |
| 5,782,112 | A | 7/1998 | White et al. |
| 5,803,100 | A | 9/1998 | Thies |
| 5,865,997 | A | 2/1999 | Isaacs |
| 5,868,937 | A | 2/1999 | Back et al. |
| 5,904,163 | A | 5/1999 | Inoue et al. |
| 5,924,432 | A | 7/1999 | Thies et al. |
| 6,289,908 | B1 | 9/2001 | Kelsey |
| 6,389,908 | B1 | 5/2002 | Chevalier et al. |
| 6,443,091 | B1 | 9/2002 | Matte |
| 6,460,555 | B1 | 10/2002 | Tuller et al. |
| 6,491,049 | B1 | 12/2002 | Tuller et al. |
| 6,601,593 | B2 | 8/2003 | Deiss et al. |
| 6,666,976 | B2 | 12/2003 | Benenson, Jr. et al. |
| 6,800,197 | B1 | 10/2004 | Kosola et al. |
| 6,997,195 | B2 | 2/2006 | Durazzani et al. |
| 7,047,986 | B2 | 5/2006 | Ertle et al. |
| 7,069,181 | B2 | 6/2006 | Jerg et al. |
| 7,093,604 | B2 | 8/2006 | Jung et al. |
| 7,153,817 | B2 | 12/2006 | Binder |
| 7,198,054 | B2 | 4/2007 | Welch |
| 7,208,080 | B2 | 4/2007 | Batten et al. |
| 7,232,494 | B2 | 6/2007 | Rappette |
| 7,250,174 | B2 | 7/2007 | Lee et al. |
| 7,270,132 | B2 | 9/2007 | Inui et al. |
| 7,319,841 | B2 | 1/2008 | Bateman, III et al. |
| 7,326,338 | B2 | 2/2008 | Batten et al. |
| 7,347,212 | B2 | 3/2008 | Rosenbauer |
| 7,350,527 | B2 | 4/2008 | Gurubatham et al. |
| 7,363,093 | B2 | 4/2008 | King et al. |
| 7,406,843 | B2 | 8/2008 | Thies et al. |
| 7,445,013 | B2 | 11/2008 | VanderRoest et al. |
| 7,497,222 | B2 | 3/2009 | Edwards et al. |
| 7,523,758 | B2 | 4/2009 | VanderRoest et al. |
| 7,594,513 | B2 | 9/2009 | VanderRoest et al. |
| 7,819,983 | B2 | 10/2010 | Kim et al. |
| 7,896,977 | B2 | 3/2011 | Gillum et al. |
| 8,043,437 | B1 | 10/2011 | Delgado et al. |
| 8,161,986 | B2 | 4/2012 | Alessandrelli |
| 8,215,322 | B2 | 7/2012 | Fountain et al. |
| 8,667,974 | B2 | 3/2014 | Fountain et al. |
| 8,746,261 | B2 | 6/2014 | Welch |
| 9,005,369 | B2 | 4/2015 | Delgado et al. |
| 9,034,112 | B2 * | 5/2015 | Tuller ..... A47L 15/0047 134/56 D |
| 2002/0017483 | A1 | 2/2002 | Chesner et al. |
| 2003/0037809 | A1 | 2/2003 | Favaro |
| 2003/0168087 | A1 * | 9/2003 | Inui ..... A47L 15/4223 134/57 D |
| 2003/0205248 | A1 | 11/2003 | Christman et al. |
| 2004/0007253 | A1 | 1/2004 | Jung et al. |
| 2004/0103926 | A1 | 6/2004 | Ha |
| 2004/0254654 | A1 | 12/2004 | Donnelly et al. |
| 2005/0022849 | A1 | 2/2005 | Park et al. |
| 2005/0133070 | A1 | 6/2005 | Vanderroest et al. |
| 2006/0005863 | A1 | 1/2006 | Gurubatham et al. |
| 2006/0054549 | A1 | 3/2006 | Schoendorfer |
| 2006/0123563 | A1 | 6/2006 | Raney et al. |
| 2006/0162744 | A1 | 7/2006 | Walkden |
| 2006/0174915 | A1 | 8/2006 | Hedstrom et al. |
| 2006/0236556 | A1 | 10/2006 | Ferguson et al. |
| 2006/0237049 | A1 | 10/2006 | Weaver et al. |
| 2006/0237052 | A1 | 10/2006 | Picardat et al. |
| 2007/0006898 | A1 | 1/2007 | Lee |
| 2007/0107753 | A1 | 5/2007 | Jerg |
| 2007/0119478 | A1 | 5/2007 | King et al. |
| 2007/0124004 | A1 | 5/2007 | King et al. |
| 2007/0163626 | A1 | 7/2007 | Klein |
| 2007/0186964 | A1 | 8/2007 | Mason et al. |
| 2007/0246078 | A1 | 10/2007 | Purtilo et al. |
| 2007/0266587 | A1 | 11/2007 | Bringewatt et al. |
| 2007/0295360 | A1 | 12/2007 | Jerg et al. |
| 2008/0116135 | A1 | 5/2008 | Rieger et al. |
| 2008/0289654 | A1 | 11/2008 | Kim et al. |
| 2008/0289664 | A1 | 11/2008 | Rockwell et al. |
| 2009/0095330 | A1 | 4/2009 | Iwanaga et al. |
| 2009/0283111 | A1 | 11/2009 | Classen et al. |
| 2010/0012159 | A1 | 1/2010 | Verma et al. |
| 2010/0043826 | A1 | 2/2010 | Bertsch et al. |
| 2010/0043828 | A1 | 2/2010 | Choi et al. |
| 2010/0043847 | A1 | 2/2010 | Yoon et al. |
| 2010/0121497 | A1 | 5/2010 | Heisele et al. |
| 2010/0147339 | A1 | 6/2010 | Bertsch et al. |
| 2010/0154830 | A1 | 6/2010 | Lau et al. |
| 2010/0154841 | A1 | 6/2010 | Fountain et al. |
| 2010/0175762 | A1 | 7/2010 | Anacrelico |
| 2010/0224223 | A1 | 9/2010 | Kehl et al. |
| 2010/0252081 | A1 | 10/2010 | Classen et al. |
| 2010/0300499 | A1 | 12/2010 | Han et al. |
| 2011/0061682 | A1 | 3/2011 | Fountain et al. |
| 2011/0120508 | A1 | 5/2011 | Yoon et al. |
| 2011/0126865 | A1 | 6/2011 | Yoon et al. |
| 2011/0146714 | A1 | 6/2011 | Fountain et al. |
| 2011/0146730 | A1 | 6/2011 | Welch |
| 2011/0146731 | A1 | 6/2011 | Fountain et al. |
| 2012/0097200 | A1 | 4/2012 | Fountain |
| 2012/0118330 | A1 | 5/2012 | Tuller et al. |
| 2012/0118336 | A1 | 5/2012 | Welch |
| 2012/0138096 | A1 | 6/2012 | Tuller et al. |
| 2012/0138106 | A1 | 6/2012 | Fountain et al. |
| 2012/0138107 | A1 | 6/2012 | Fountain et al. |
| 2012/0291805 | A1 | 11/2012 | Tuller et al. |
| 2012/0291822 | A1 | 11/2012 | Tuller et al. |
| 2012/0318295 | A1 | 12/2012 | Delgado et al. |
| 2012/0318296 | A1 | 12/2012 | Fountain et al. |
| 2012/0318308 | A1 | 12/2012 | Fountain et al. |
| 2012/0318309 | A1 | 12/2012 | Tuller et al. |

FOREIGN PATENT DOCUMENTS

| | | | |
|---|---|---|---|
| CN | 2761660 | | 3/2006 |
| CN | 1966129 | | 5/2007 |
| CN | 2907830 | | 6/2007 |
| CN | 101406379 | | 4/2009 |
| CN | 201276653 | | 7/2009 |
| CN | 201361486 | | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | A1 | 10/1991 |

(56) References Cited

FOREIGN PATENT DOCUMENTS

| | | | |
|---|---|---|---|
| DE | 4016915 | A1 | 11/1991 |
| DE | 4131914 | A1 | 4/1993 |
| DE | 9415486 | U1 | 11/1994 |
| DE | 9416710 | U1 | 1/1995 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | A1 | 6/2011 |
| DE | 102011052846 | A1 | 5/2012 |
| DE | 102012103435 | A1 | 12/2012 |
| EP | 0068974 | A1 | 1/1983 |
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 0752231 | A1 | 1/1997 |
| EP | 752231 | A1 | 1/1997 |
| EP | 0854311 | A2 | 7/1998 |
| EP | 0855165 | A2 | 7/1998 |
| EP | 0898928 | A1 | 3/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1583455 | A1 | 10/2005 |
| EP | 1703834 | A1 | 9/2006 |
| EP | 1743871 | A1 | 1/2007 |
| EP | 1862104 | A1 | 12/2007 |
| EP | 1882436 | A1 | 1/2008 |
| EP | 1980193 | A1 | 10/2008 |
| EP | 2127587 | A1 | 2/2009 |
| EP | 2075366 | A1 | 7/2009 |
| EP | 2138087 | A1 | 12/2009 |
| EP | 2332457 | A1 | 6/2011 |
| EP | 2335547 | A1 | 6/2011 |
| EP | 2338400 | A1 | 6/2011 |
| EP | 2351507 | A1 | 8/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1047948 | | 11/1966 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 20010077128 | | 8/2001 |
| KR | 20090006659 | | 1/2009 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

German Search Report for DE102010061215, Feb. 7, 2013.
European Search Report for EP11188106, Mar. 29, 2012.
German Search Report for DE102010061346, Sep. 30, 2011.
German Search Report for DE102010061343, Jul. 7, 2011.
German Search Report for DE102011053666, Oct. 21, 2011.
German Search Report for DE102010061342, Aug. 19, 2011.
European Search Report for EP101952380, May 19, 2011.
European Search Report for EP12188007, Aug. 6, 2013.
German Search Report for DE102013103264, Jul. 12, 2013.
German Search Report for DE102013103625, Jul. 19, 2013.
Ishihara et al., JP 11155792 A, English Machine Translation, 1999, pp. 1-14.
German Search Report for Counterpart DE102014101260.7, Sep. 18, 2014.
German Search Report for Counterpart DE102013109125, Dec. 9, 2013.

* cited by examiner

DISHWASHER WITH UNITARY WASH MODULE

BACKGROUND OF THE INVENTION

Contemporary automatic dishwashers for use in a typical household include a tub for receiving soiled dishes to be cleaned. A spray system and a recirculation system may be provided for re-circulating liquid throughout the tub to remove soils from the dishes. The dishwasher may have a controller that implements a number of pre-programmed cycles of operation to wash dishes contained in the tub.

SUMMARY OF THE INVENTION

One embodiment of the invention relates to a dishwasher for treating dishes according to at least one cycle of operation having a tub at least partially defining a treating chamber for receiving the dishes, at least one sprayer located in the treating chamber and spraying liquid into the treating chamber, a liquid recirculation system defining a recirculation flow path having multiple recirculation circuits, with one of the circuits coupled to the at least one sprayer, a liquid diverter provided within the flow path and operable to select between at least two of the multiple circuits for inclusion in the recirculation flow path, an air supply system having an air supply conduit fluidly coupled to the tub and a blower having a selectively positionable blower shutter and fluidly coupled with the air supply conduit to supply air to the tub from the blower, and a drive system having a single motor and operably coupled to the liquid diverter and the blower shutter to control the position of the liquid diverter and the position of the blower shutter.

Another embodiment of the invention relates to a dishwasher for treating dishes according to at least one cycle of operation, the dishwasher having a first tub at least partially defining a first treating chamber, a second tub at least partially defining a second treating chamber physically separate from the first treating chamber, a liquid recirculation system, a liquid diverter provided within the recirculation flow path for selectively directing liquid to at least one of the first treating chamber and the second treating chamber, an air supply system selectively fluidly coupled to at least one of the first treating chamber and the second treating chamber to selectively supply air thereto, a second diverter for selectively directing air to at least one of the first treating chamber and the second treating chamber, and a drive system having a single motor and operably coupled to the first diverter and the second diverter to control the positions of the first and second diverters.

Yet another embodiment of the invention relates to a dishwasher for treating dishes according to at least one automatic cycle of operation, the dishwasher having a tub at least partially defining a treating chamber having a liquid outlet, at least one sprayer located in the treating chamber and spraying liquid into the treating chamber, a liquid recirculation system defining a recirculation flow path having multiple recirculation circuits, with one of the circuits coupled to the at least one sprayer, a pump fluidly coupled to the recirculation flow path to pump the liquid to the at least one sprayer, a rotating filter located within the recirculation flow path and mounted to an impeller of the pump to effect the rotation of the filter, and a liquid diverter provided within the flow path and operable to select between at least two of the multiple circuits for inclusion in the recirculation flow path and wherein the liquid diverter is a hemispherical seal having a single opening to control the flow of liquid from the pump to one of the at least two of the multiple circuits

DESCRIPTION OF EMBODIMENTS OF THE INVENTION

Figure 1:
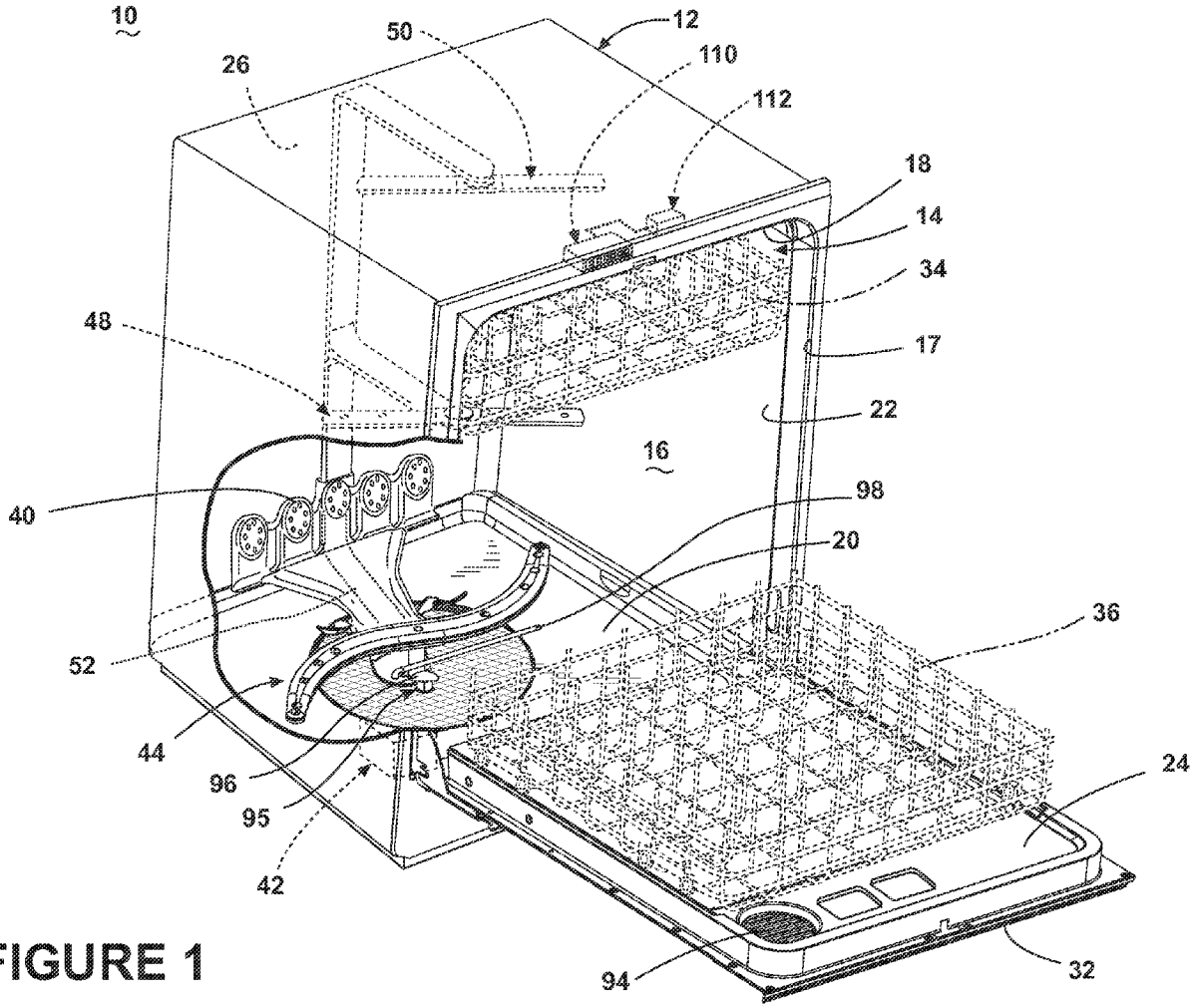
FIG. 1 is a perspective view of a dishwasher in accordance with a first embodiment of the invention.

Referring to FIG. 1, a first embodiment of the invention is illustrated as a dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention.

The cabinet 12 encloses a tub 14 at least partially defining a treating chamber 16 for holding dishes for washing according to a cycle of operation and defining an access opening 17. The tub 14 has spaced top and bottom walls 18 and 20, spaced sidewalls 22, a front wall 24, and a rear wall 26. In this configuration, the walls 18, 20, 22, 24, and 26 collectively define the treating chamber 16 for treating or washing dishes. The bottom wall 20 may have a front lip 28 (FIG. 2) with an upper portion 30 that may define a portion of the access opening 17. The front wall 24 may be at least partially defined by a door 32 of the dishwasher 10, which may be pivotally attached to the dishwasher 10 for providing accessibility to the treating chamber 16 through the access opening 17 for loading and unloading dishes or other washable items. More specifically, the door 32 may be configured to selectively open and close the access opening 17.

Dish holders in the form of upper and lower dish racks 34, 36 are located within the treating chamber 16 and receive dishes for washing. The upper and lower racks 34, 36 may be mounted for slidable movement in and out of the treating chamber 16 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While the present invention is described in terms of a conventional dishwashing unit as illustrated in FIG. 1, it could also be implemented in other types of dishwashing units such as in-sink dishwashers or drawer dishwashers including drawer dishwashers having multiple compartments.

Figure 2:
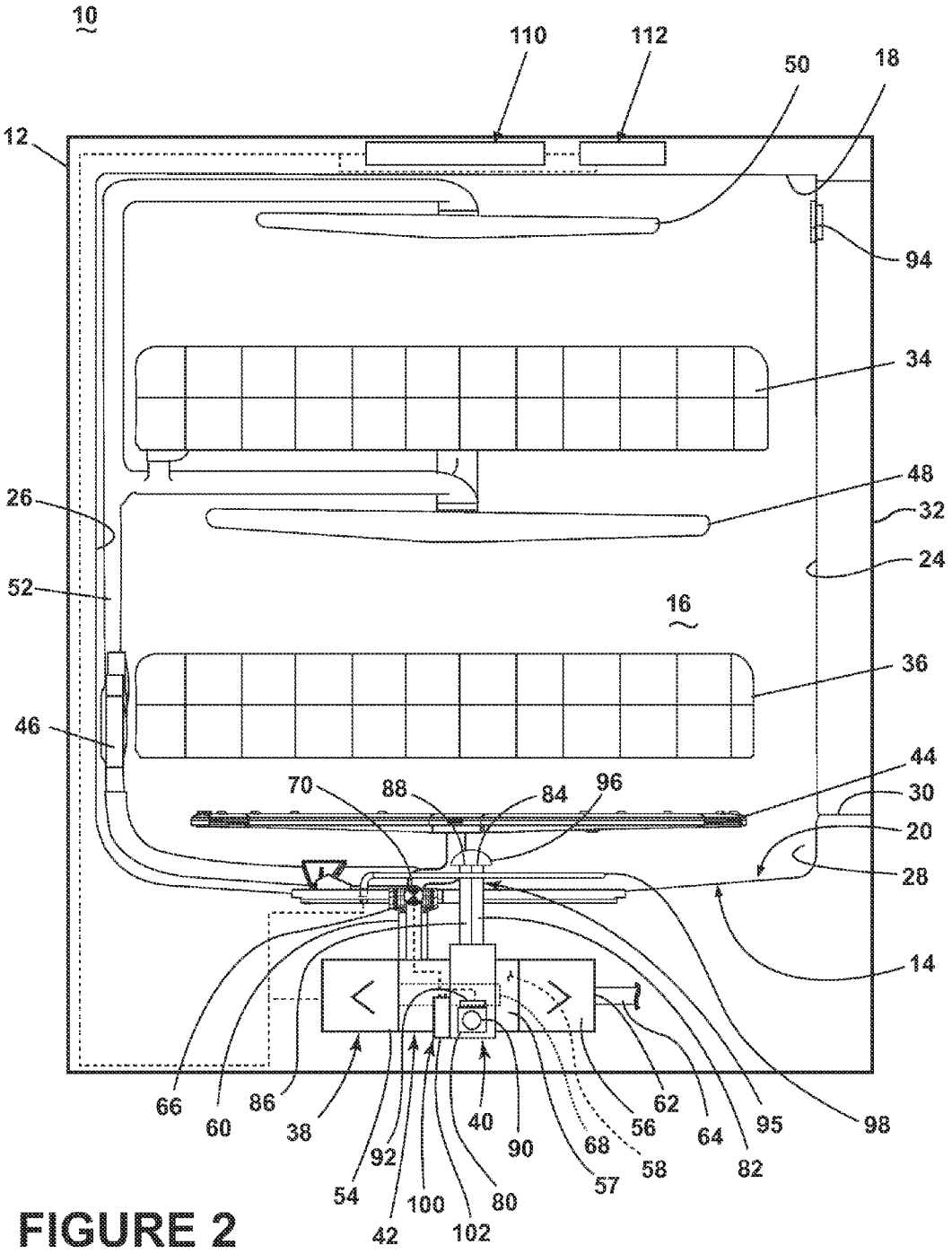
FIG. 2 is a partial schematic cross-sectional view of the dishwasher shown in FIG. 1 and illustrating a recirculation system and air supply system.

Referring to FIG. 2, the major systems of the dishwasher 10 and their interrelationship may be seen. For example, a liquid recirculation system 38 is provided for spraying liquid within the treating chamber 16 to treat any dishes located therein and an air supply system 40 is provided for supplying air to the treating chamber 16 for aiding in the drying of the dishes. The recirculation system may include a remote sump and filter unit 42 that is operably coupled to the liquid recirculation system 38 and the air supply system 40. Among other things, the remote sump and filter unit 42 may provide pumping and filtering for the liquid recirculation system 38, a heating function for the both the liquid recirculation system 38 and the air supply system 40, and a draining function.

The liquid recirculation system 38 may include one or more sprayers for spraying liquid within the treating chamber 16 and defines a recirculation flow path for recirculating the sprayed liquid from the treating chamber 16 to the one or more sprayers. As illustrated, there are four sprayers: a first lower spray assembly 44, a second lower spray assembly 46, a mid-level spray assembly 48, and an upper spray assembly 50, which may be supplied liquid from a supply tube 52. The first lower spray assembly 44 is positioned above the bottom wall 20 and beneath the lower dish rack 36. The first lower spray assembly 44 is an arm configured to rotate in the wash tub 14 and spray a flow of liquid from a plurality of spray nozzles or outlets, in a primarily upward direction, over a portion of the interior of the wash tub 14. A first wash zone may be defined by the spray field emitted by the first lower spray assembly 44 into the treating chamber 16. The spray from the first lower spray assembly 44 is sprayed into the wash tub 14 in typically upward fashion to wash dishes located in the lower dish rack 36. The first lower spray assembly 44 may optionally also provide a liquid spray downwardly onto a lower portion of the treating chamber 16, but for purposes of simplification, this will not be illustrated or described herein.

The second lower spray assembly 46 is illustrated as being located adjacent the lower rack 36 toward the rear of the treating chamber 16. The second lower spray assembly 46 is illustrated as including a horizontally oriented distribution header or spray manifold having a plurality of nozzles. The second lower spray assembly 46 may not be limited to this position; rather, the second lower spray assembly 46 could be located in virtually any part of the treating chamber 16. Alternatively, the second lower spray assembly 46 could be positioned underneath the lower rack 36, adjacent or beneath the first lower spray assembly 44. Such a spray manifold is set forth in detail in U.S. Pat. No. 7,594,513, issued Sep. 29, 2009, and titled "Multiple Wash Zone Dishwasher," which is incorporated herein by reference in its entirety. The second lower spray assembly 46 may be configured to spray a flow of treating liquid in a generally lateral direction, over a portion of the interior of the treating chamber 16. The spray may be typically directed to treat dishes located in the lower rack 36. A second wash zone may be defined by the spray field emitted by the second lower spray assembly 46 into the treating chamber 16. When both the first lower spray assembly 44 and the second lower spray assembly 46 emit spray fields the first and second zones may intersect.

The mid-level spray arm assembly 48 is positioned between the upper dish rack 34 and the lower dish rack 36. Like the first lower spray assembly 44, the mid-level spray assembly 48 may also be configured to rotate in the dishwasher 10 and spray a flow of liquid in a generally upward direction, over a portion of the interior of the wash tub 14. In this case, the spray from the mid-level spray arm assembly 48 is directed to dishes in the upper dish rack 34 to define a third spray zone. In contrast, the upper spray arm assembly 50 is positioned above the upper dish rack 34 and generally directs a spray of liquid in a generally downward direction to define a fourth spray zone that helps wash dishes on both upper and lower dish racks 34, 36.

The remote sump and filter unit 42 may include a wash or recirculation pump 54 and a drain pump 56, which are fluidly coupled to a housing 57 defining a sump 58, where liquid sprayed into the wash tub 14 will collect due to gravity. As illustrated, the housing 57 is physically separate from the wash tub 14 and provides a mounting structure for the recirculation pump 54 and drain pump 56. An inlet conduit 60 fluidly couples the wash tub 14 to the housing 57 and provides a path for the liquid in the treating chamber 16 to travel to the sump 58. As illustrated, the recirculation pump 54 fluidly couples the sump 58 to the supply tube 52 to effect a supplying of the liquid from the sump 58 to the sprayers. As illustrated, the drain pump 56 fluidly couples to a drain pump outlet 62 to effect a supplying of liquid from the sump to a household drain 64.

It is contemplated that multiple supply tubes 52 may be included within the dishwasher 10 and that one or more valves may be provided with the recirculation flow path to control the flow of liquid within the dishwasher 10. Liquid may be selectively supplied to a subset of all of the sprayers and/or simultaneously to all of the sprayers. The inlet conduit 60, sump 58, recirculation pump 54, spray assemblies 44-50, and supply tube(s) 52 collectively form a recirculation flow path in the liquid recirculation system 38. It will be understood that the recirculation flow path includes multiple recirculation circuits, with one of the circuits coupled to at least one of the sprayers forming the spray assemblies 44-50. One or more valves or diverters, shown schematically as liquid diverter 70, may be included in the dishwasher 10 to control the flow of liquid to the spray assemblies 44-50 from the recirculation pump 54. The liquid diverter 70 is provided within the recirculation flow path and is operable to select between at least two of the multiple circuits for inclusion in the recirculation flow path. In this manner, the liquid diverter 70 may direct liquid from the recirculation pump 54 to include in the recirculation flow path at least one of the multiple sprayers forming the spray assemblies 44-50.

A filter may be located somewhere within the liquid flow path such that soil and foreign objects may be filtered from the liquid. As an example, a filter 66 has been illustrated as being located inside the inlet conduit 60 such that soil and debris may be filtered from the liquid as it travels from an opening in the bottom wall 20 to the sump 58. The filter 66 may be a strainer, which may be employed to retain larger soil particles but allows smaller particles to pass through. An optional filter element 68 has been illustrated in FIG. 2 as being located within the housing 57 between the inlet conduit 60 and the recirculation pump 54.

The recirculation pump 54 may be fluidly coupled to the recirculation path such that it draws liquid in through the inlet conduit 60 and sump 58 and delivers it to one or more of the spray assemblies 44-50 through the supply tube(s) 52 depending on the operation of the liquid diverter 70. The liquid is sprayed back into the treating chamber 16 through the spray assemblies 44-50 and drains back to the sump 58 where the process may be repeated.

The drain pump 56 may also be fluidly coupled to the housing 57. The drain pump 56 may be adapted to draw liquid from the housing 57 and to pump the liquid through a drain pump outlet 62 to a household drain 64. As illustrated, the dishwasher 10 includes a recirculation pump 54 and a drain pump 56. Alternatively, it is possible for the two pumps to be replaced by a single pump, which may be operated to supply to either the household drain or to the recirculation system.

The air supply system 40 may include a fan or blower 80, an air supply conduit 82 having an outlet 84 and an air return conduit 86 having an inlet 88. The blower 80 may be fluidly coupled with the air supply conduit 82 to supply air to the treating chamber 16 from the blower 80 as well as being fluidly coupled to the air return conduit 86 to draw air from the treating chamber 16. Thus, the air supply conduit 82 may be configured to provide air to the treating chamber 16 while the air return conduit 86 may be configured to remove air from the treating chamber 16.

The air supply conduit 82 and the air return conduit 86 are illustrated as being included in a standpipe 95 that extends through the bottom wall 20 of the tub into the treating chamber. A cover 96 or other means may be used to inhibit the entrance of sprayed liquid into the air supply conduit 82 and the air return conduit 86 by shielding the air supply conduit outlet 84 and the air return conduit inlet 88. While the air supply conduit 82 and the air return conduit 86 are illustrated as being located in the center of the bottom wall 20 and extending into the treating chamber 16 it is contemplated that they may be suitably located anywhere in the tub 14.

The air supply system may also include an inlet 90 located below the bottom wall 20 such that air exterior to the tub 14, i.e., "ambient air", may be provided to the treating chamber 16. In this manner the blower 80 includes a first inlet open to air in the dishwasher 10, which is the air return conduit inlet 88 and a second inlet open to ambient air, which is the inlet 90.

The blower 80 includes a selectively positionable blower shutter 92, which may control a ratio of air from the air return conduit inlet 88 and the inlet 90 to the treating chamber 16. The blower shutter 92 may be controlled such that the ratio of air from the inlet 90 and air from the air return conduit 86 may be controlled. In this manner, the blower 80 may be fluidly coupled to the inlet 90, as well as the air supply conduit 82 and the air return conduit 86 and the blower shutter 92 may control the ratio of the recirculated air and the ambient air provided to the treating chamber through the air supply conduit 82.

Further, the air supply system 40 may include an outlet fluidly open to ambient air. An example of such an outlet has been illustrated as a vent 94, which may exhaust the supplied air from the treating chamber 16. The vent 94 may be fluidly coupled to an outlet duct (not shown), which vents into the interior of the door 32, allowing air to escape through the various openings in the door 32.

A drive system 100 having a single motor 102 has also been illustrated and may be operably coupled to the liquid diverter 70 and the blower shutter 92 to control the position of the liquid diverter 70 and the position of the blower shutter 92. The drive system 100 may independently control the position of the liquid diverter 70 and the position of the blower shutter 92. Alternatively, the control of the position of the liquid diverter 70 and the position of the blower shutter 92 by the drive system 100 may be linked or related in some manner.

A heater 98 may be located in the treating chamber 16 near the bottom wall 20 to heat liquid in the treating chamber 16. Alternatively, or in addition to the heater 98, a heater 140 (FIG. 5) may be located on the housing 57 and the heater 140 may be configured to heat air in the air supply system 40 and the liquid in the liquid recirculation system 38.

A control panel or user interface 110 provided on the dishwasher 10 and coupled to a controller 112 may be used to select a cycle of operation. The user interface 110 may be provided on the cabinet 12 or on the outer panel of the door 32 and can include operational controls such as dials, lights, switches, and displays enabling a user to input commands to the controller 112 and receive information about the selected cycle of operation. The dishwasher 10 may further include other conventional components such as additional valves, a dispensing system for dispensing treating chemistries or rinse aids, spray arms or nozzles, etc.; however, these components are not germane to the present invention and will not be described further herein.

Figure 3:
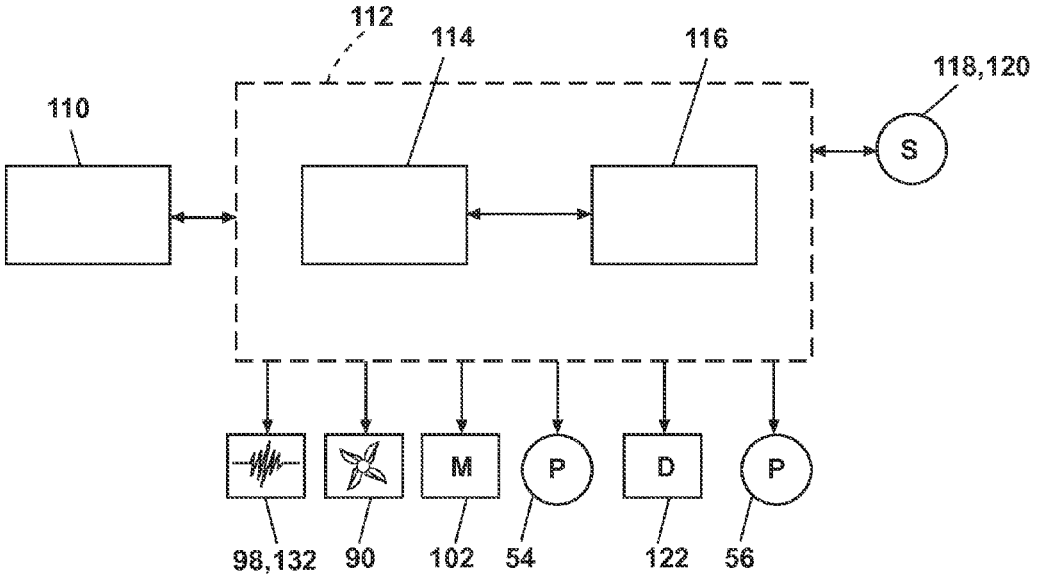
FIG. 3 is a schematic view of a control system of the dishwasher of FIG. 1.

As illustrated in FIG. 3, the controller 112 may be provided with a memory 114 and a central processing unit (CPU) 116. The memory 114 may be used for storing control software that may be executed by the CPU 116 in completing a cycle of operation using the dishwasher 10 and any additional software. For example, the memory 114 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 112 may be operably coupled with one or more components of the dishwasher 10 for communicating with and controlling the operation of the components to complete a cycle of operation. For example, the controller 112 may be coupled with the recirculation pump 54 for circulation of liquid in the wash tub 14 and the drain pump 56 for drainage of liquid in the wash tub 14. The controller 112 may also be operably coupled with the blower 80 and the blower shutter 92 to provide air into the wash tub 14.

Further, the controller 112 may also be coupled with one or more temperature sensors 118, which are known in the art and not shown for simplicity, such that the controller 112 may control the duration of the steps of the cycle of operation based upon the temperature detected. The controller 112 may also receive inputs from one or more other optional sensors 120, which are known in the art and not shown for simplicity. Non-limiting examples of optional sensors 120 that may be communicably coupled with the controller 112 include a moisture sensor, a door sensor, a detergent and rinse aid presence/type sensor(s), and a potion sensor. The controller 112 may also be coupled to a dispenser 122, which may dispense a detergent during the wash step of the cycle of operation or a rinse aid during the rinse step of the cycle of operation.

Figure 4:
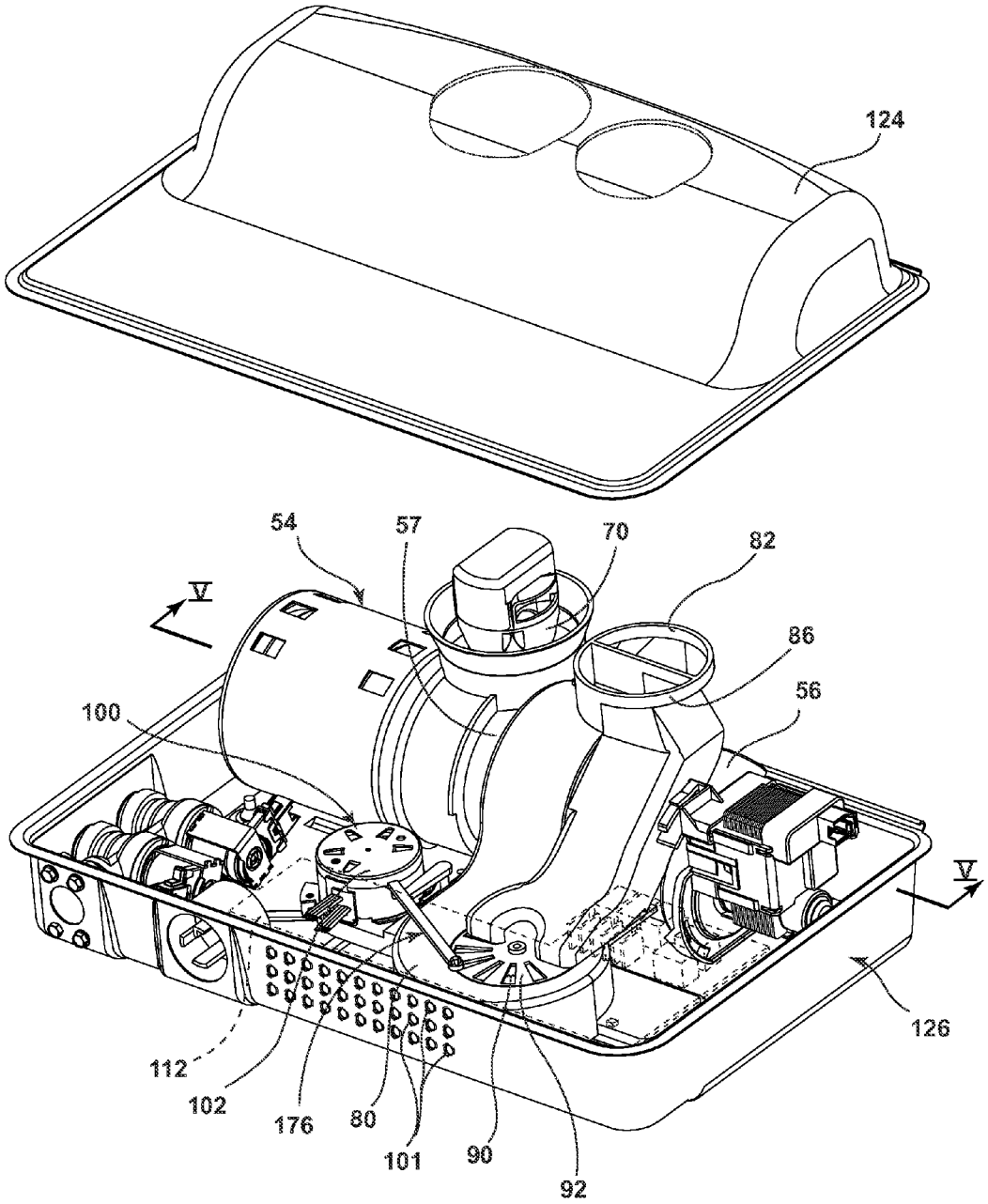
FIG. 4 is a perspective view of one embodiment of a remote sump and filter unit and its couplings to the recirculation system and air supply system illustrated in FIG. 2.

FIG. 4 illustrates a perspective view of one embodiment of the remote sump and filter unit 42. A cover 124 of the remote sump and filter unit 42 has been exploded from the remainder of the remote sump and filter unit 42 for clarity. The cover 124 may be mounted to a bottom 126 containing the remote sump and filter unit 42 in any suitable manner. The bottom 126 may include louvers or openings 101 to allow ambient air into the container formed by the bottom 126 and the cover 124.

The remote sump and filter unit 42 has a drain pump 56 and recirculation pump 54 mounted to the housing 57. Portions of the air supply system 40 wrap around the housing 57. It will be understood that only a portion of both the air supply conduit 82 and the air return conduit 86 are illustrated and that the remainder of the standpipe 95 has not been illustrated.

Figure 5:
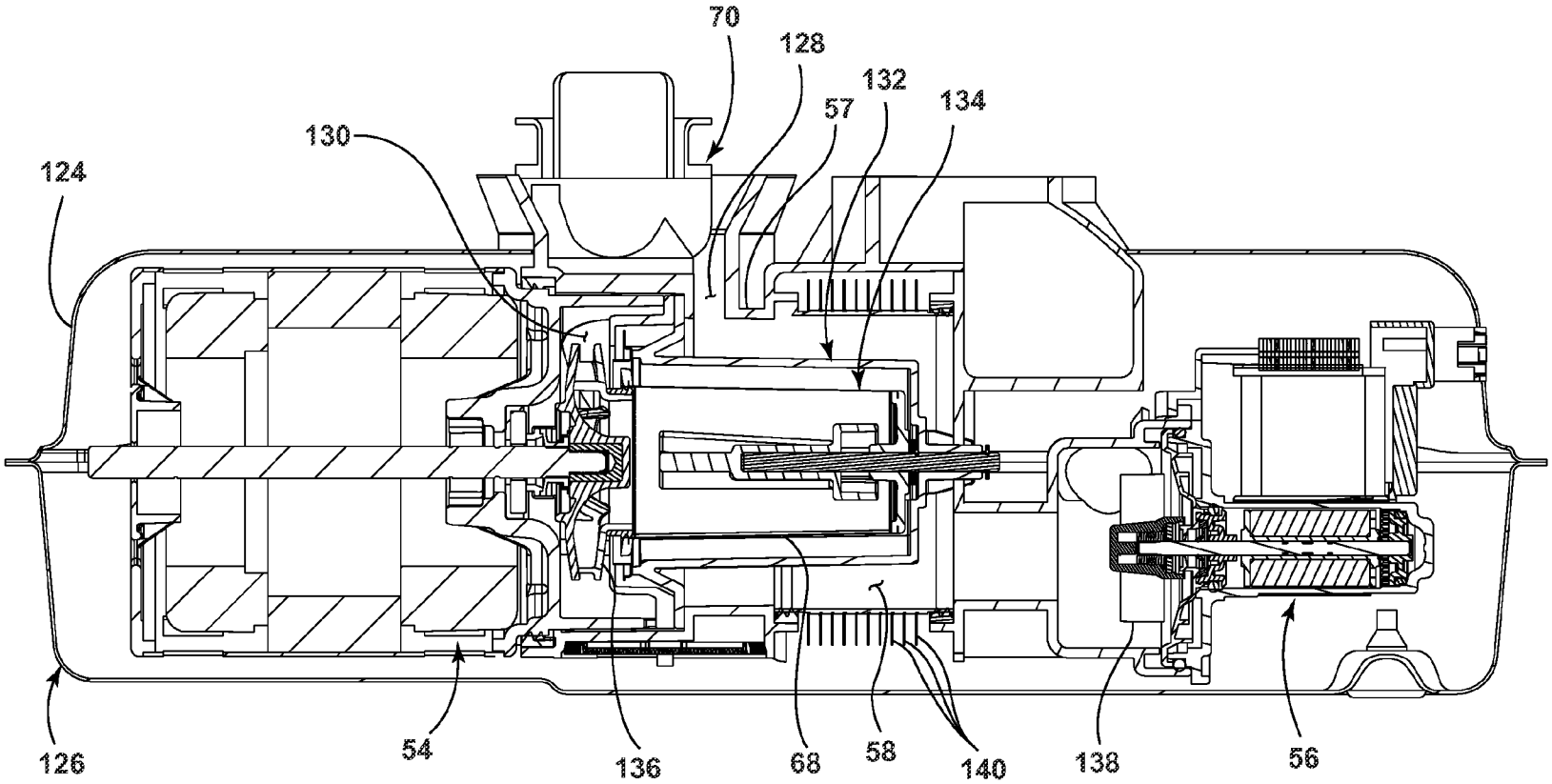
FIG. 5 is a cross-sectional view of the remote sump and filter unit of FIG. 4.

Referring to FIG. 5, a filter element 68 may be located in the housing 57 and fluidly disposed between the housing inlet 128 and housing outlet 130 to filter liquid passing through the sump 58. Because the housing 57 is located within the cabinet 12 but physically remote from the wash tub 14, the filter element 68 is not directly exposed to the wash tub 14. In this manner, the housing 57 and filter element 68 may be thought of as defining a filter unit, which is separate and remote from the wash tub 14. The filter element 68 may be a fine filter, which may be utilized to remove smaller particles from the liquid. The filter element 68 may be a rotating filter utilizing a shroud 132 and a first diverter 134 to aid in keeping the filter element 68 clean, such a rotating filter element 68 and additional elements such as the shroud 132 and diverter 134 are set forth in detail in U.S. patent application Ser. No. 13/483,254, filed May 30, 2012, and titled "Rotating Filter for a Dishwasher," which is incorporated herein by reference in its entirety. The rotating filter according to U.S. patent application Ser. No. 13/483,254 may be operably coupled to an impeller 136 of the recirculation pump 54 such that when the impeller 136 rotates the filter element 68 is also rotated.

The drain pump 56 may also be fluidly coupled to the housing 57. The drain pump 56 includes an impeller 138 which may draw liquid from the housing 57 and pump it through a drain pump outlet 62 to a household drain 64 (FIG. 2). The filter element 68 is not fluidly disposed between the housing inlet 128 and the drain pump outlet 62 such that unfiltered liquid may be removed from the sump 58.

The housing 57 has been illustrated as being located inside a portion of the air supply system 40. The heater 140 may be operably coupled to the controller 112 and may be positioned such that it is mounted to the housing 57 and shared by the liquid recirculation system 38 and the remote sump and filter unit 42. More specifically, it has been illustrated that the heater 140 is mounted to an exterior of the housing 57 where the air supply system 40 wraps around the housing 57. In this location, the heater 140 may provide heated air and heated liquid into the wash tub 14 at the same time or may provide heated air and heated liquid into the wash tub 14 separately. Alternatively, it has been contemplated that the heater 140 may be mounted to an interior of the housing 57 or that portions of the heater 140 could be mounted on both the interior and the exterior of the housing 57. Any suitable heater may be used for the heater 140 including a coiled heater, multiple ring heater, or a film heater mounted on the housing 57, which has been illustrated by way of example.

Figure 6:
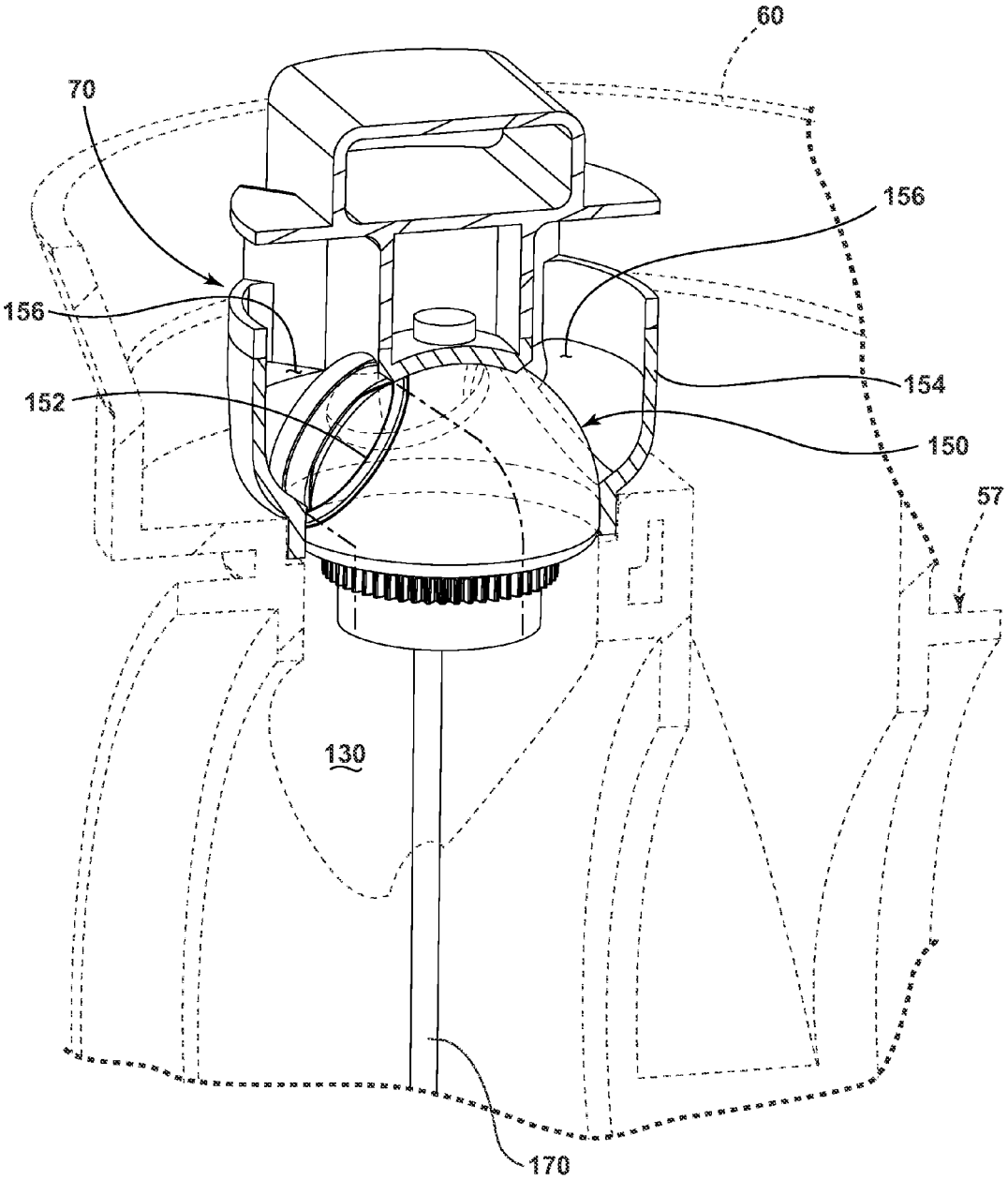
FIG. 6 is a cross-sectional view of a diverter of the remote sump and filter unit of FIG. 4.

The liquid diverter 70 has been better illustrated in FIG. 6 and, as illustrated, includes a hemispherical seal 150 having a single opening 152 to control the flow of liquid from the recirculation pump 54 to at least one of the multiple circuits in the recirculation flow path. It will be understood that any suitable liquid diverter 70 may be used including a diverter valve; such a diverter valve may have any number of outlets to diverter liquid to at least one of the multiple circuits in the recirculation flow path. Yet another example, of a suitable liquid diverter 70 may include a rotatable diverter disk such as set forth in detail in U.S. patent application Ser. No. 12/908,915, filed Oct. 21, 2010, and titled "Dishwasher with Controlled Rotation of Lower Spray Arm," which is incorporated herein by reference in its entirety.

In the illustrated embodiment and by way of example only, the multiple circuits are at least partially defined by a recirculation manifold 154 having multiple outlets 156. Each of the multiple outlets 156 may be operably coupled to, for example, each of the spray assemblies 44-50, respectively such that each of the multiple outlets 156 may direct liquid from the recirculation pump 54 to one of the multiple sprayers. The single opening 152 of the hemispherical seal 150 is dimensioned such that it may align with one of the multiple outlets 156 to selectively control a flow of liquid to one of the multiple outlets 156 for its inclusion in the recirculation flow path. It has been contemplated that the hemispherical seal 150 may be more than one opening and that the recirculation manifold 154 may have any number of outlets 156.

Figure 7:
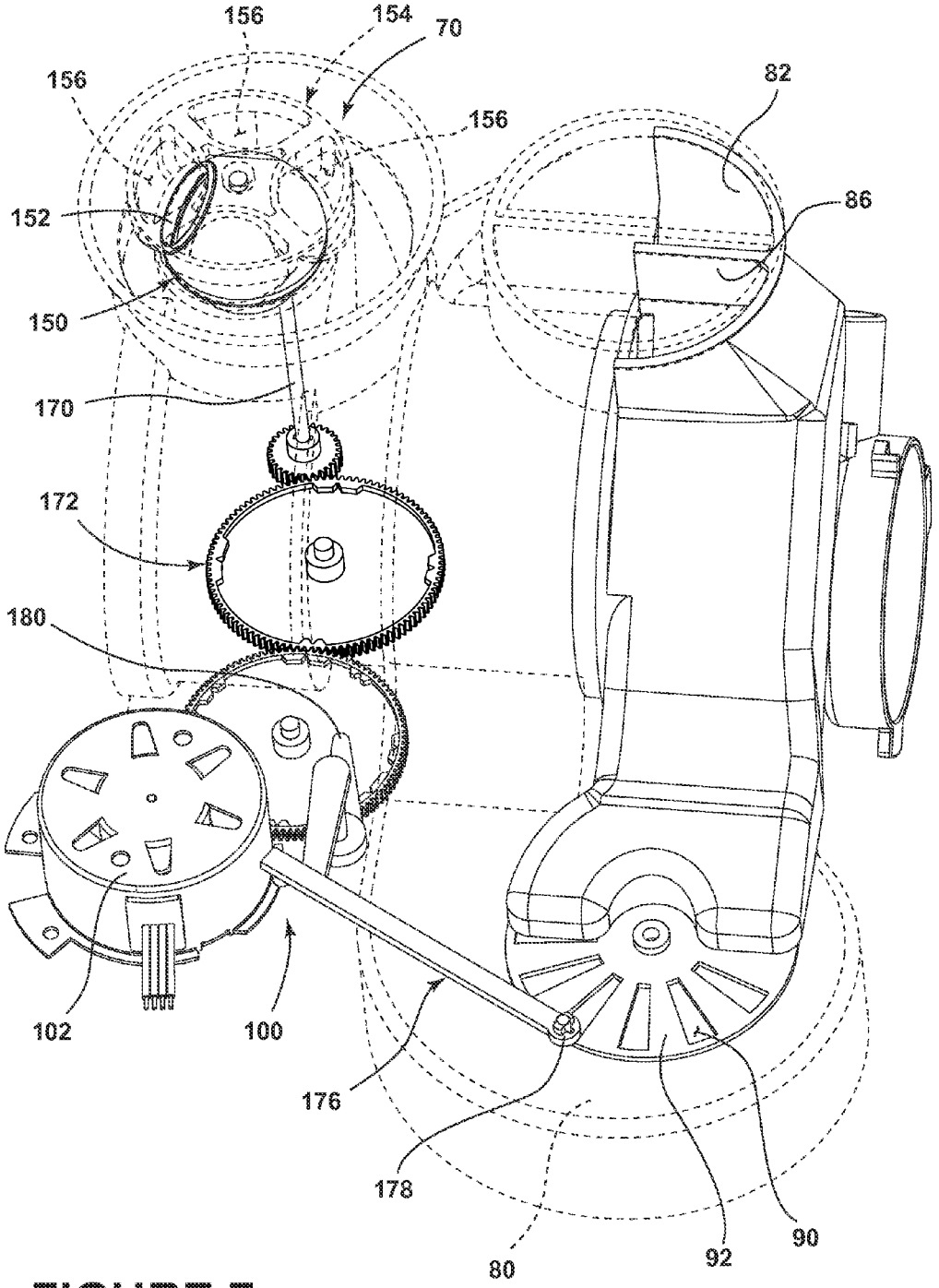
FIG. 7 is a perspective view of a portion of the remote sump and filter unit of FIG. 4.

As illustrated in FIG. 7, the drive system 100 having a single motor 102 is operably coupled to the liquid hemispherical seal 150 and the blower shutter 92 to control the position of both the single opening 152 of the hemispherical seal 150 and the position of the blower shutter 92. While the drive system 100 may include any suitable couplings to the liquid diverter 70 and the blower shutter 92 an exemplary coupling will be described.

In the exemplary embodiment, the drive system 100 includes a drive shaft 170 coupled between the motor 102 and the hemispherical seal 150 and which uses the power from the motor 102 to drive the rotation of the hemispherical seal 150. More specifically, the drive shaft 170 is operably coupled to the hemispherical seal 150 and an output of a gear train 172, which couples to an output of the motor 102. The motor 102 may thus cause the gear train 172 to rotate which in turn causes the drive shaft 170 and the hemispherical seal 150 to rotate. The hemispherical seal 150 may be rotated by the drive system 100 between multiple positions to selectively divert liquid flowing from the recirculation pump 54 between the spray assemblies 44-50.

The drive system 100 also includes a cam mechanism 176 coupled between the motor 102 and the blower shutter 92 and which uses the power from the motor 102 to change the position of the blower shutter 92. More specifically, a first end 178 of the cam mechanism 176 is operably coupled to the blower shutter 92 and a second end 180 of the cam mechanism 176 couples to an output of the motor 102. The motor 102 may thus cause the movement of the cam mechanism 176 which in turn causes the position of the blower shutter 92 to change.

The motor 102 may be bi-directional and the gear train 172 and cam mechanism 176 may be operably coupled to the output of the motor 102 such that they may be moved when the motor 102 is operated in either direction. The drive system 100 may include a suitable sensor for determining the location of the gear train 172, the drive shaft 170, the hemispherical seal 150, and/or the cam mechanism 176. For example, it is contemplated that a position sensor may provide feedback regarding the position of the opening 152. The controller 112 may control the location of the opening 152 based on the signal from the position sensor to direct the liquid to the desired one or more spray assemblies 44-50. Further, a position sensor may be provided to sense the position of the cam mechanism 176 and the controller 112 may control the operation of the drive system 100 based on the output from the position sensor to move the cam mechanism 176 and obtain the desired ratio of ambient air from the inlet 90 and recirculated air from the air return conduit 86. Any suitable position sensor, including an optical sensor and a hall-effect sensor, may be used.

During operation of the dishwasher 10, the liquid recirculation system 38 may be employed to provide liquid to one or more of the spray assemblies 44-50. Liquid in the wash tub 14 passes into the housing 57 where it may collect in the sump 58. At an appropriate time during the cycle of operation to spray liquid into the treating chamber 16, the controller 112 signals the recirculation pump 54 to supply liquid to one or more of the spray assemblies 44-50. The recirculation pump 54 draws liquid from the sump 58 through the filter element 68 and the recirculation pump 54 where it may then be delivered to one or more of the spray assemblies 44-50 through the liquid diverter 70, the supply tube(s) 52, and any other associated valving or diverters.

The movement of the opening 152 relative to the multiple outlets 156 selectively fluidly connects the housing outlet 130 to one or more of the spray assemblies 44-50, which is accomplished by aligning or partially aligning one or more of the opening 152 with one or more of the multiple outlets 156. Activation of the motor 102 of the drive system 100 by the controller 112 turns the gear train 172, which in turn rotates the drive shaft 170 and causes the rotatable hemispherical seal 150 to turn. In this manner, the output from the single motor 102 effects rotation of the hemispherical seal 150. The amount of time that the opening 152 is fluidly connected with each of the multiple outlets 156 controls the duration of time that each of the various spray assemblies 44-50 spray liquid.

After achieving the desired fluid coupling of one or more spray assemblies 44-50 with the recirculation pump 54, the motor 102 may be deactivated so that fluid coupling may be maintained, or may be continued to rotate the drive shaft 170 such that each of the spray assemblies 44-50 is sequentially coupled with the housing outlet 130. During operation, positive pressure of the liquid flowing through the recirculation flow path may press the hemispherical seal 150 against the recirculation manifold 154 such that liquid only flows through the opening 152.

Regardless of whether the air is heated or not, the blower 80 may force air into the wash tub 14. The air travels upward within the treating chamber 16 and exits the treating chamber 16 through the vent 94 or is removed from the treating chamber 16 via air return conduit 86. The blower 80 may draw in air from the air return conduit 86 and/or the inlet 90 depending upon the position of the blower shutter 92. More specifically, the position of the blower shutter 92 controls the ratio of ambient air from the inlet 90 and recirculated air from the air return conduit 86. The blower shutter 92 may be positionable to entirely close off the inlets 90 such that no ambient air is allowed to enter the treating chamber 16.

More specifically openings of the blower shutter may be aligned or partially aligned with openings of the inlet 90 to allow ambient air to be provided to the treating chamber 16. Activation of the motor 102 of the drive system 100 by the controller 112 moves the cam mechanism 176, which in turn causes movement of the blower shutter 92. In this manner, the output from the single motor 102 effects movement of the blower shutter 92. After achieving the desired ratio of ambient to recirculated air, the motor 102 may be deactivated so that ratio may be maintained.

It has been contemplated that the air supply system 40 may be operated while the liquid recirculation system 38 is also being operated. It has also been contemplated that the air supply system 40 may be operated separately to form a drying portion of the operational cycle.

Figure 8:
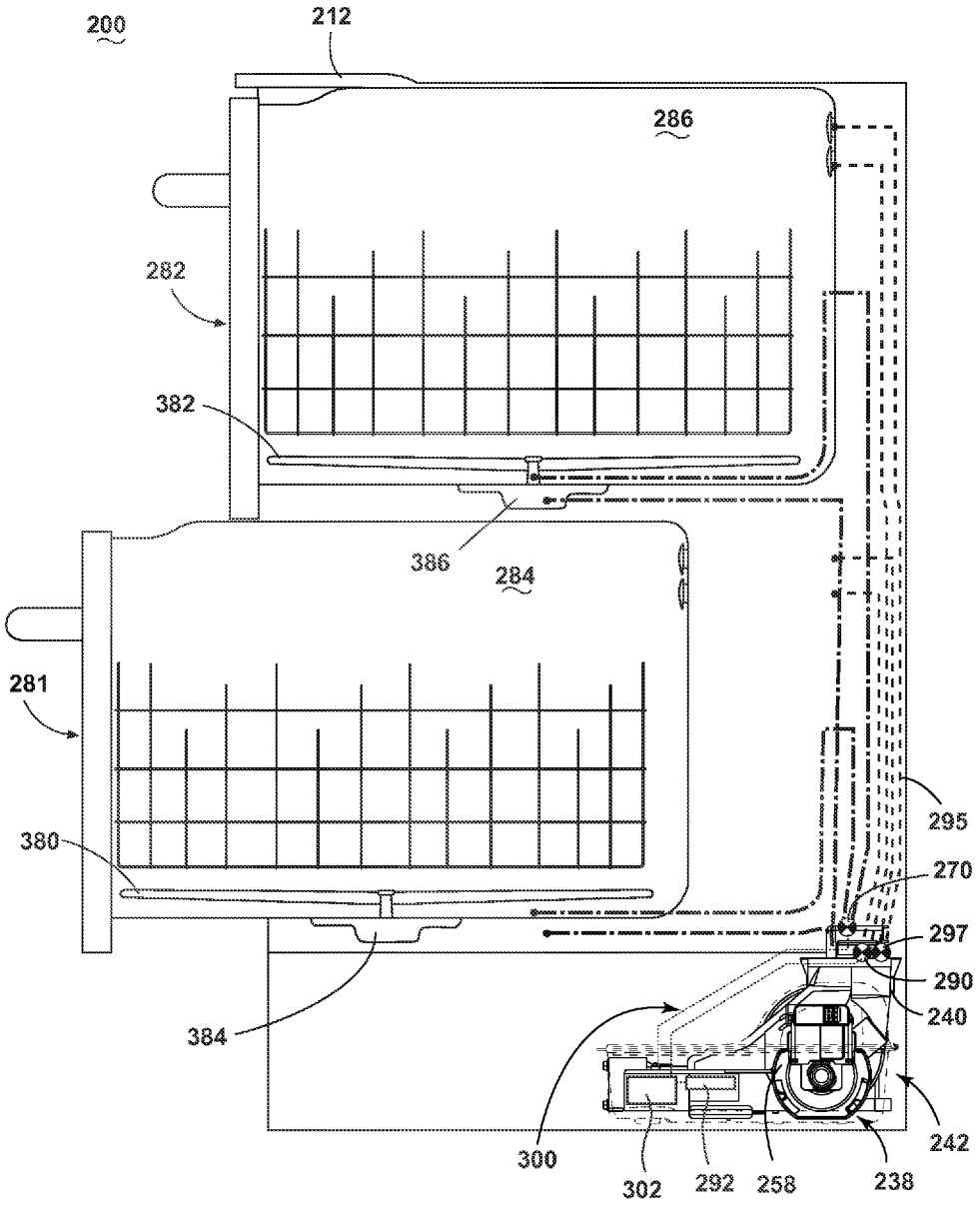
FIG. 8 is a cross-sectional view of a portion of a dishwasher in accordance with a second embodiment of the invention.

FIG. 8 illustrates another embodiment of the invention wherein a remote sump and filter unit 242 is illustrated as being located in a multi-compartment dishwasher 200 having a first compartment or tub 281 and a second compartment or tub 282. In this embodiment, the tubs 281, 282 each partially define a treating chamber 284, 286, respectively. The first and second tubs 281, 282 are moveable elements and take the form of slide-out drawer units of similar size, each having a handle for facilitating movement of the first and second tubs 281, 282 between an open and closed position. The tubs 281, 282 are slidably mounted to a chassis 212 through a pair of extendible support guides (not shown). The upper compartment 282 is illustrated in the closed position and the lower compartment 281 is illustrated in a partially open position. Notably, the remote sump and filter unit 242 is not carried by either drawer and is illustrated as being positioned in the lower-rear portion of the chassis 212.

As with the previously described embodiments, the dishwasher 200 includes a liquid recirculation system 238 selectively fluidly coupled to first treating chamber 284 and the second treating chamber 286 to selectively supply liquid thereto and form a recirculation flow path. A liquid diverter 270 is provided within the recirculation flow path for selectively directing liquid to at least one of the first treating chamber 284 and the second treating chamber 286. The liquid diverter 270 may be any suitable liquid diverter including a hemispherical seal having a single opening as previously described with respect to the second embodiment above. The liquid diverter is configured to include in the recirculation flow path at least one of the tubs. It is also contemplated that either or both of the first and second tubs may include multiple sprayers (not shown) and that the liquid diverter may be configured to include in the recirculation flow path at least one of the multiple sprayers.

It should be noted that each of the first and second tubs 281, 282 have separate liquid inlets 380 and 382, in the form of sprayers, and separate liquid outlets 384 and 386. The liquid inlets 380 and 382 and outlets 384 and 386 are fluidly coupled to the remote sump and filter unit 242 through the recirculation system 238. The remote sump and filter unit 242 includes a housing 257 defining a sump 258 that is physically separate from both of the first and second tubs 281, 282. The sump 258 may receive liquid sprayed into the first treating chamber 284 and the second treating chamber 286. The housing 257 has an inlet 328 fluidly connected to the liquid outlets 384 and 386 when the first and second tubs 281, 282 are in the closed position and an outlet 330, selectively fluidly coupled to the sprayers or liquid inlets 380 and 382 through the liquid diverter 270 when the first and second tubs 281, 282 are in the closed position to define a recirculation path for the sprayed liquid. The remote sump and filter unit 242 may include a drain pump (not shown) and controller 310, as well as a filter unit (not shown) located within the sump 258 and remote from the first and second tubs 281, 282, and other components like the embodiments disclosed above.

An air supply system 240 may selectively fluidly couple to at least one of the first treating chamber 284 and the second treating chamber 286 to selectively supply air thereto. A second diverter 290 for selectively directing air to at least one of the first treating chamber 284 and the second treating chamber 286 may also be included in the dishwasher 200. An air return system 295 has also been illustrated and may include one of more diverters, schematically illustrated as 297. As with the earlier embodiments the air supply system 240 may include a blower 280 having a selectively positionable blower shutter 292 for controlling a ratio of air from the air return system 295 and an inlet open to ambient air.

A drive system 300 having a single motor 302 may be operably coupled to the first diverter 270 and the second diverter 290 to control the positions of the first and second diverters 270 and 290. The blower shutter 292 may also be operably coupled to the drive system 300 to selectively control the position of the blower shutter 292. It is contemplated that the drive system 300 may independently control the position of the first diverter 270, second diverter 290, and the position of the blower shutter 292.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

The embodiments of the invention described above allow for a variety of benefits including a simple construction, which requires fewer parts to manufacture the dishwasher. The embodiments of the invention described above allow for a single drive system to control a variety of components in the dishwasher, which reduces the cost associated with the manufacture of the dishwasher.

While the invention has been specifically described in connection with certain specific embodiments thereof, it is to be understood that this is by way of illustration and not of limitation, and the scope of the appended claims should be construed as broadly as the prior art will permit. For example, it has been contemplated that the invention may differ from the configurations shown in FIGS. 1-8, such as by inclusion of other conduits, dish racks, valves, spray assemblies, seals, and the like, to control the flow of liquid and the supply of air.

What is claimed is:

1. A dishwasher for treating dishes according to at least one cycle of operation comprising:

a tub at least partially defining a treating chamber for receiving the dishes;

at least one sprayer located in the treating chamber and spraying liquid into the treating chamber;

a liquid recirculation system defining a recirculation flow path having multiple recirculation circuits, with one of the circuits coupled to the at least one sprayer;

a liquid diverter provided within the flow path and operable to select between at least two of the multiple circuits for inclusion in the recirculation flow path;

an air supply system having an air supply conduit fluidly coupled to the tub and a blower having a selectively positionable blower shutter and fluidly coupled with the air supply conduit to supply air to the tub from the blower; and a drive system having a cam mechanism mounted to the blower shutter, a drive shaft mounted to the liquid diverter, and a single motor mechanically coupled to the cam mechanism and the drive shaft to control the position of the liquid diverter and the position of the blower shutter.

2. The dishwasher of claim 1 wherein the blower further comprises a first inlet open to air in the dishwasher and a second inlet open to ambient air.

3. The dishwasher of claim 2 wherein the blower shutter controls a ratio of air from the first inlet and the second inlet.

4. The dishwasher of claim 3 wherein the drive system may independently control the position of the liquid diverter and the position of the blower shutter.

5. The dishwasher of claim 1 wherein the air supply system further comprises an outlet fluidly open to ambient air.

6. The dishwasher of claim 1, further comprising multiple sprayers configured to provide a spray of liquid into the treating chamber.

7. The dishwasher of claim 6 wherein the liquid diverter is configured to include in the recirculation flow path at least one of the multiple sprayers.

8. THe dishwasher of claim 1, further comprising a second tub at least partially defining a second treating chamber for receiving dishes.

9. The dishwasher of claim 8 wherein the liquid diverter is configured to include in the recirculation flow path at least one of the tubs.

10. The dishwasher of claim 9, further comprising multiple sprayers for each of the tubs and where the each of the multiple sprayers is configured to provide a spray of liquid into one of the treating chambers.

11. The dishwasher of claim 10 wherein the liquid diverter is configured to include in the recirculation flow path at least one of the multiple sprayers.

12. The dishwasher of claim 1 wherein the liquid diverter includes a hemispherical seal having a single opening to control a flow of liquid for inclusion in the recirculation flow path.

13. The dishwasher of claim 12, further comprising a recirculation manifold forming at least a portion of the at least two of the multiple circuits and wherein positive pressure of the liquid flowing through the recirculation flow path presses the seal against the recirculation manifold.

14. The dishwasher of claim 13, further comprising a pump for selectively recirculating the sprayed liquid.

15. The dishwasher of claim 14, further comprising a filter located within the recirculation flow path to filter liquid recirculated through the recirculation flow path.

16. The dishwasher of claim 15 wherein the filter is a rotating filter and is mounted to an impeller of the pump to effect the rotation of the filter.

17. The dishwasher of claim 16, further comprising a sump remote from the tub and wherein the filter is located in the sump such that the filter is not directly exposed to the tub.

18. The dishwasher of claim 1 wherein the drive system comprises a gear train coupling the cam mechanism to the drive shaft operably coupled to the liquid diverter such that output from the single motor effects rotation of the liquid diverter via the gear train.

19. A dishwasher for treating dishes according to at least one automatic cycle of operation, the dishwasher comprising:

a tub at least partially defining a treating chamber;

at least one sprayer located in the treating chamber and spraying liquid into the treating chamber;

a liquid recirculation system defining a recirculation flow path having multiple recirculation circuits, with one of the circuits coupled to the at least one sprayer;

a pump fluidly coupled to the recirculation flow path to pump the liquid to the at least one sprayer;

a rotating filter located within the recirculation flow path and mounted to an impeller of the pump to effect the rotation of the filter;

a liquid diverter provided within the flow path and operable to select between at least two of the multiple circuits for inclusion in the recirculation flow path; and a drive system having a cam mechanism mounted to a blower shutter, a drive shaft mounted to the liquid diverter, and a single motor mechanically coupled to the cam mechanism and the drive shaft to control the position of the liquid diverter and the position of the blower shutter;

wherein the liquid diverter is a hemispherical seal having a single opening to control a flow of liquid from the pump to one of the at least two of the multiple circuits.

20. The dishwasher of claim 19 wherein the at least one sprayer includes multiple sprayers configured to provide a spray of liquid into the treating chamber.

21. The dishwasher of claim 20 wherein the liquid diverter is configured to direct liquid from the pump to one of the multiple sprayers.

22. The dishwasher of claim 19, further comprising a second tub at least partially defining a second treating chamber.

23. The dishwasher of claim 22 wherein the liquid diverter is configured to direct liquid from the pump to one of the tubs.

24. The dishwasher of claim 23, further comprising multiple sprayers for each of the tubs where the each of the multiple sprayers is configured to provide a spray of liquid into one of the treating chambers.

25. The dishwasher of claim 24 wherein the diverter is configured to direct liquid from the pump to one of the multiple sprayers.

26. The dishwasher of claim 19, further comprising a recirculation manifold forming at least a portion of the at least two of the multiple circuits and wherein positive pressure of the liquid flowing from the pump presses the seal against a recirculation manifold.

27. The dishwasher of claim 26, further comprising a drive system for positioning the selectively positionable liquid diverter.

* * * * *